US009155441B2

(12) United States Patent
Williams et al.

(10) Patent No.: US 9,155,441 B2
(45) Date of Patent: Oct. 13, 2015

(54) TUBULAR HEADBAND MOUNTED WET MOP

(71) Applicant: Rubbermaid Commercial Products, LLC, Winchester, VA (US)

(72) Inventors: Todd Allen Williams, Aliso Viejo, CA (US); Cynthia Kay Williams, Aliso Viejo, CA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 94 days.

(21) Appl. No.: 14/053,424

(22) Filed: Oct. 14, 2013

(65) Prior Publication Data

US 2015/0101141 A1 Apr. 16, 2015

Related U.S. Application Data

(63) Continuation-in-part of application No. 13/850,983, filed on Mar. 26, 2013, now Pat. No. 9,010,873, which is a continuation-in-part of application No. 13/221,275, filed on Aug. 30, 2011, now Pat. No. 8,585,154.

(60) Provisional application No. 61/379,402, filed on Sep. 2, 2010.

(51) Int. Cl.
*A47L 13/252* (2006.01)

(52) U.S. Cl.
CPC ..... *A47L 13/252* (2013.01)

(58) Field of Classification Search
CPC ..... A47L 13/20; A47L 13/252; A47L 13/44
USPC ..... 15/229.1–229.8
See application file for complete search history.

(56) References Cited

U.S. PATENT DOCUMENTS

| | | | | |
|---|---|---|---|---|
| 1,398,245 | A | 11/1921 | Toplitz | |
| 1,450,556 | A | 4/1923 | McKeever | |
| 1,576,777 | A | 3/1926 | Moore | |
| 2,686,328 | A * | 8/1954 | Kirby | 15/229.1 |
| 3,135,002 | A | 6/1964 | Moss | |
| 3,324,497 | A | 6/1967 | Moss | |
| 3,381,334 | A * | 5/1968 | Redmond | 15/229.3 |
| 3,795,934 | A | 3/1974 | Moss | |
| 3,966,259 | A | 6/1976 | Richards | |
| 3,981,040 | A | 9/1976 | Crofton | |
| 5,784,746 | A | 7/1998 | Williams et al. | |
| 5,848,451 | A | 12/1998 | Barnett | |
| 6,212,729 | B1 | 4/2001 | Weichelt et al. | |
| 6,270,166 | B2 | 8/2001 | Weichelt et al. | |
| 2008/0016640 | A1 | 1/2008 | Reddy et al. | |

* cited by examiner

*Primary Examiner* — Shay Karls
(74) *Attorney, Agent, or Firm* — Sutherland Asbill & Brennan LLP

(57) ABSTRACT

There is a need to reduce raw materials used in the manufacturing of wet mops, to reduce the weight of the wet mop which will decrease user fatigue and related injuries and to address the difficulty of attaching standard wet mops to commonly used mop handles. The improvement is a tubular headband wet mop with yarn strands on only one side of the headband, reducing the amount of unused yarn incorporated into the wet mop while not reducing floor surface coverage area. The tubular headband also eliminates the possibility of exposing the bottom side of the mop handle which can damage or mar the floor surface, coatings and finishes. This reduction in raw materials results in a lighter product, which reduces effort required to lift and wring out the wet mop, and reduces fatigue and injuries associated with mopping.

18 Claims, 8 Drawing Sheets

TUBULAR HEADBAND MOUNTED WET MOP

CROSS REFERENCE TO RELATED APPLICATION

This application is a continuation-in-part of U.S. application Ser. No. 13/850,983 filed Mar. 26, 2013, which is a continuation-in-part of U.S. application Ser. No. 13/221,275 filed on Aug. 30, 2011, now U.S. Pat. No. 8,585,154, which claims the benefit of Provisional Application Ser. No. 61/379,402 filed Sep. 2, 2010, the entire contents of which are hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to a tubular headband mounted wet mop allowing for ease in mounting a wet mop to a mop handle versus a standard mounted wet mop, while reducing the overall weight of a wet mop required to clean the same surface area versus a standard mounted wet mop.

2. Description of Related Art Including Information Disclosed Under 37 CFR 1.97 and 1.98:

Wet mops are typically used to clean floors or other essentially flat surfaces. The mop is manufactured and constructed to provide maximum effectiveness in picking up surface dirt, soils and liquids from the floor surface. A typical standard wet mop is made by sewing a headband in the middle of strands of cord. The headband is then captured by a clamp or retainer on a mop handle. A typical standard wet mop is constructed with a headband sewn to a mop handle, creating a four-sided wet mop. The four-sided mop consists of two exterior sides and two interior sides. The exterior sides are typically the only sides that are in contact with the floor surface. A standard wet mop has the potential to damage flooring surfaces, coatings and finishes when the clamping device of the mop handle comes in contact with the floor surface. Several products and patents have been filed and issued on different types of wet mop heads. Exemplary examples of patents covering these products are disclosed herein.

U.S. Pat. No. 5,784,746 that issued on Jul. 28, 1998 to Todd Williams and U.S. Pat. No. 5,848,451 that issued on Dec. 15, 1998 to Rickie Barnett both disclose mop heads with abrasive or scrubbing surfaces. While these patents disclose mop heads, the mop head is constructed with strands of cord with the headband sewn in mid span of the strands of cord.

U.S. Pat. No. 6,212,729 issued Apr. 10, 2001 and U.S. Pat. No. 6,270,166 that issued on Aug. 7, 2001, both to Joel Weichelt et al., disclose a fabric wet mop. The mop is constructed with strands of cord or filler with a cloth covering.

These mops provide two exterior and two interior surfaces for cleaning, but only the exterior surfaces are typically used.

U.S. Pat. No. 3,966,259 that issued on Jun. 29, 1976 to Ernest Richards and U.S. Pat. No. 3,981,040 that issued on Sep. 21, 1976, to John Cofton both disclose a wet mop construction where the mop is constructed by sewing a fabric body with a plurality of pile yarns placed on only one side of the fabric body. The pile of yarns exists on only the outside surface of the mop head. While this patent provides for a construction of mop using one sided fabric, the mop is not constructed from elongated strands of cord and further has limited flexibility to move around obstacles.

What is needed is a headband that eliminates the need for a four sided mop, creating a two-sided mop wherein both sides of the strands or cords are utilized. The elimination of the unused interior sides of a four-sided mop reduces the weight of the mop and also the cost to construct a mop where only half of the strands of cord are in contact with the floor surface area. The headband disclosed in this application provides a solution to this problem.

BRIEF SUMMARY OF THE INVENTION

It is an object of the wet mop with an enclosed tubular mounting cavity. The mop can be either a tubular headband wet mop that is then slid over a clamping device, or an enclosed headband design that is inserted into a jaw clamping device.

It is an object of the headband wet mop to eliminate the need to manually fold the headband in half in order to mount the headband to a jaw style handle by providing optional filling material of the headband. The filler material can be the mop strands, folded headband cloth or separate filler material.

It is another object of the headband wet mop to eliminate the need to balance or center the wet mop on the mop clamping device.

It is another object of the headband wet mop that by simply sliding the tubular headband onto the clamping arm the tubular structure reduces or eliminates the difficulty associated with yarns getting hung up on the clamping arm while attaching and removing the wet mop.

It is still another object of the wet mop to be an improvement upon standard mops that are four sided, with yarn strands on both sides of the headband. By incorporating the tubular headband, one of those sides is eliminated because the yarns can end inside of the headband, thereby potentially reducing the amount of yarn incorporated into the wet mop. These reductions in raw materials result in a lighter product, which will help reduce effort required, fatigue, discomfort, strain and injury while mopping a floor, lifting the mop in and out of the mop bucket and the mop bucket wringer, as well as the reduced effort required for effectively wringing out the wet mop. In the tubular design, the tubular cavity completely encases the clamping device, thereby eliminating any potential damage to floor surfaces, coatings and finishes.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Figure 8:
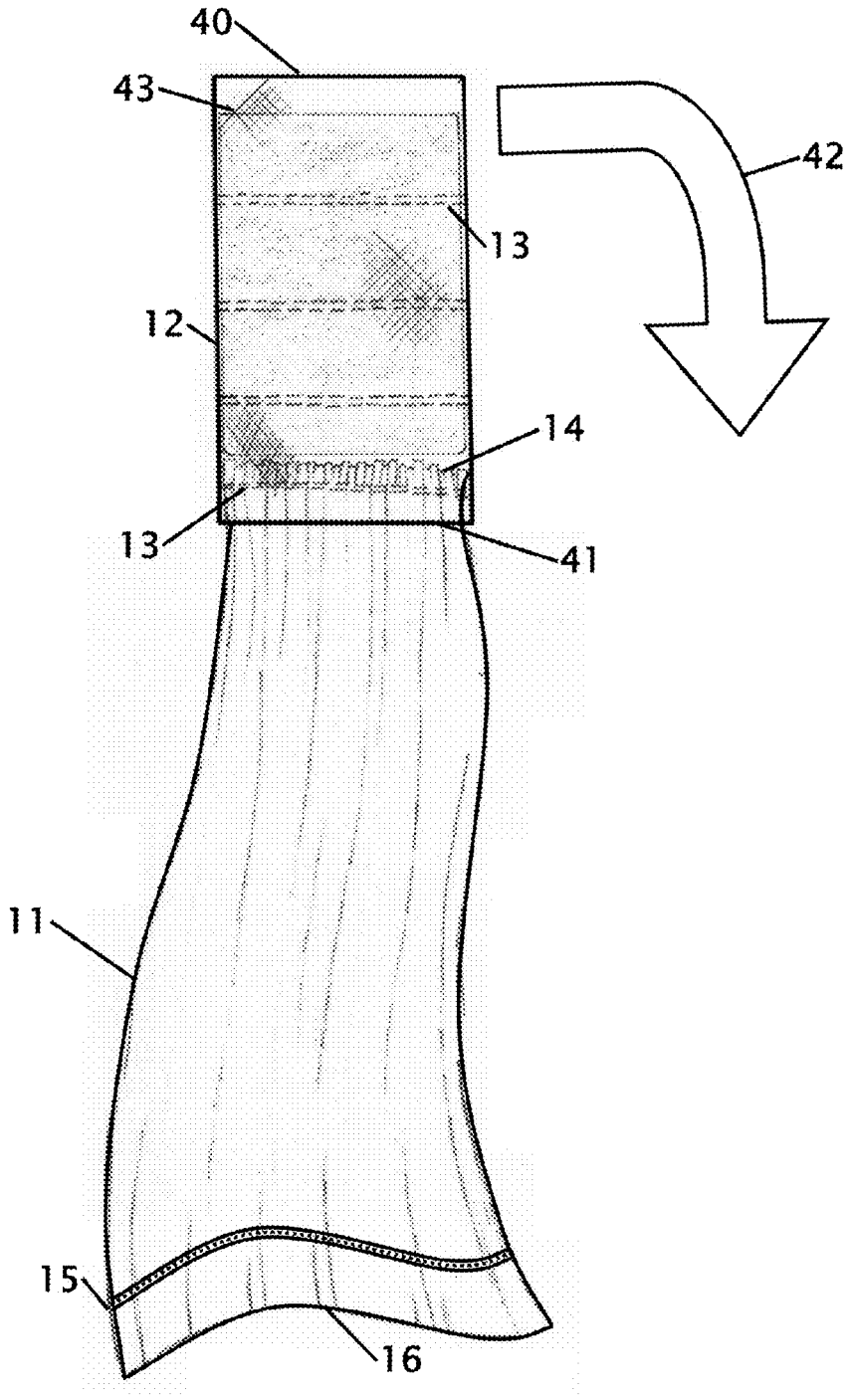

FIG. 8 the wet mop yarn, headband filler material and the headband prior to the headband being sewn over closed.

DETAILED DESCRIPTION OF THE INVENTION

Figure 1:
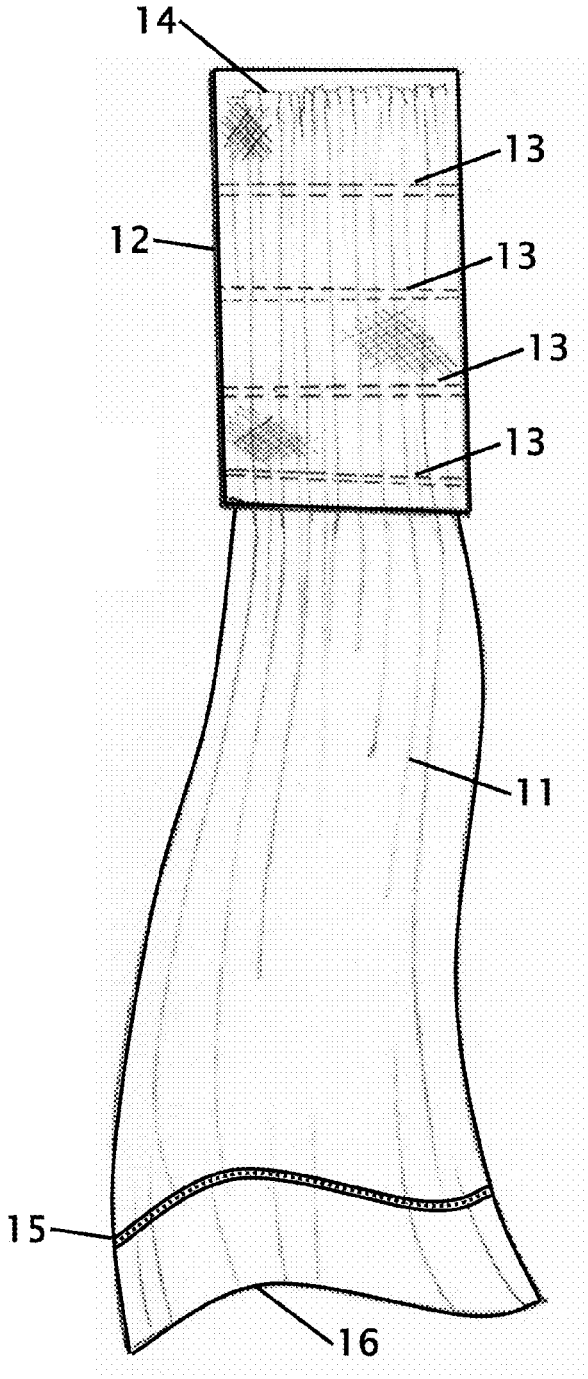
FIG. 1 shows the headband wet mop and yarns prior to the enclosure of the tubular cavity.

FIG. 1 shows the headband wet mop and yarn strands prior to the enclosure of the ends of the headband. The yarn strands 11 composed of any material such as, but not limited to cotton, microfiber, polyester, rayon, nylon, t-shirt material, synthetics, or blends, ending or looping inside the headband 12. This figure shows possible seam patterns 13 which are designed to retain the yarn strands and provide shaping and support to the headband, these seam patterns may be changed due to manufacturing or other techniques or reasons. The location and form of the seam patterns are not part of this invention. Item 14 shows the yarns ending or looping inside the headband towards the end, however the yams could end anywhere inside the headband. The mop shown has one tail band 15, but could have 0 to 5 tail bands. 16 is the end of the mop which may be cut end, or looped end. In FIG. 1 the elongated strands of yarn are used as filler material to provide structural strength to the headband 12.

Figure 2:
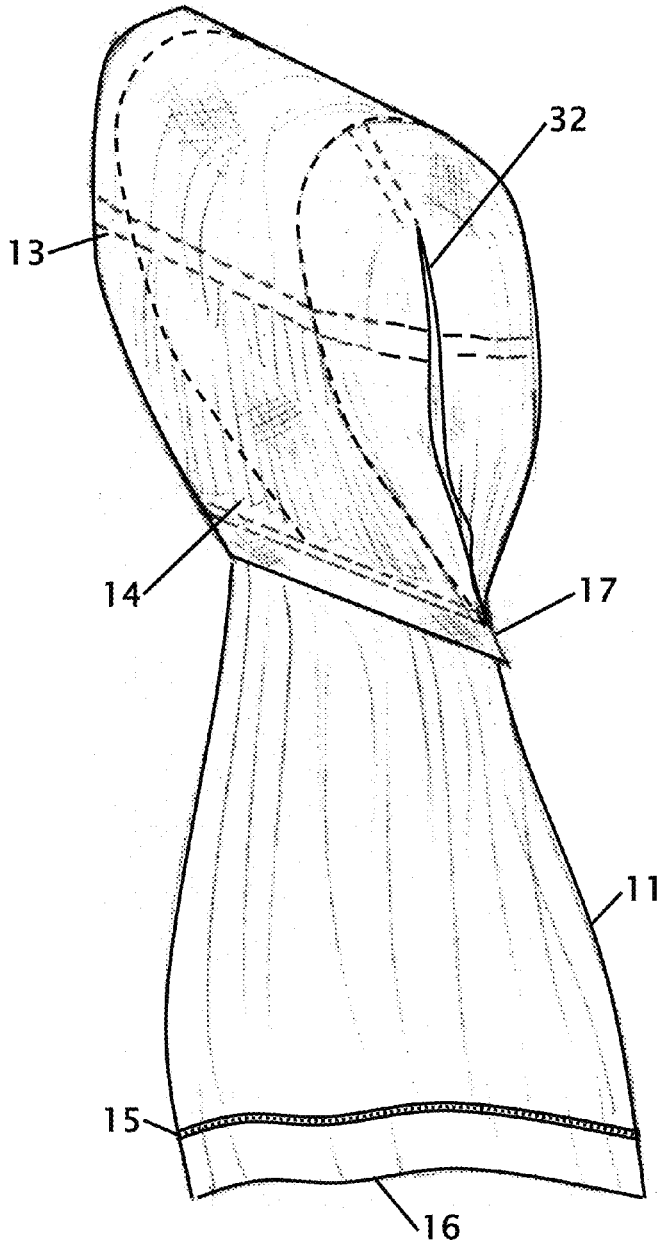
FIG. 2 shows the tubular headband wet mop after enclosure of the tubular cavity of the elements.
Figure 3:
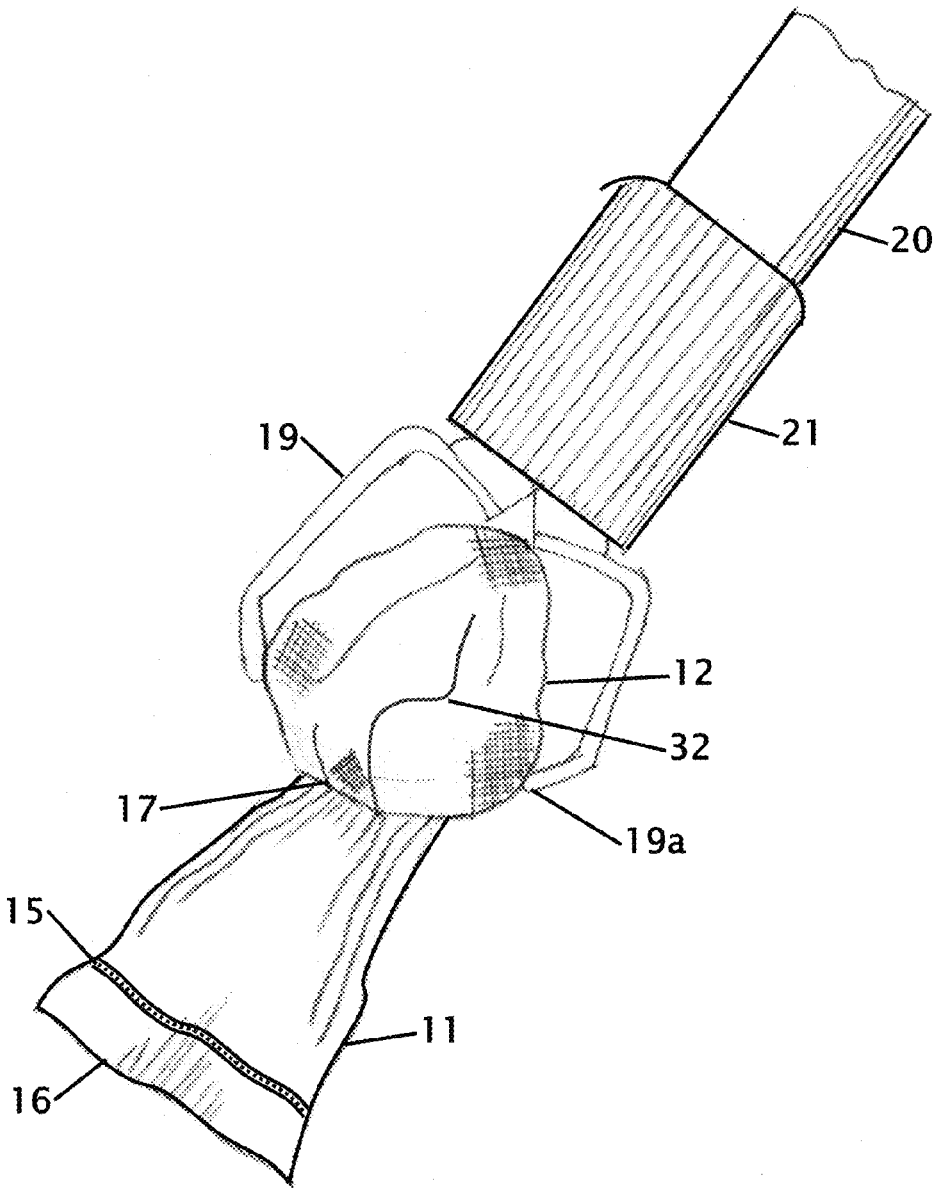
FIG. 3 shows an adjustable jaw connection 19 of the mop handle 20 to the tubular headband wet mop.

FIG. 2 shows the headband of the wet mop after enclosure of the tubular cavity of the elements referred to above with the headband configured in a closed condition creating a bound headband for gripping with a jaw type mop handle (as shown in FIG. 3). 17 shows where the headband folds, rolled, collects of overlaps itself and is attached with methods such as, but not limited to seams, tape, or staples in order to create a closed mop head 32. The closed mop head 32 has an interior cavity with an interior diameter of between 0.5 inches and 3 inches. These dimensions are given to provide optimal fit for a mop holder. The headband has a length of between 1 inch and 15 inches and more preferably a length of between 5 inches and 8 inches. The length dimensions accommodate most mops that are in consumer and industrial use. The filler material of yarn, headband cloth or separately added filler material and the headband is a yarn fabric or mesh having a width of between 2.5 inches and 12 inches and more preferably a width of between 5 inches and 7 inches to fit the majority of mop holders. The length dimensions accommodate most mops that are in consumer and industrial use.

FIG. 3 shows an adjustable jaw connection 19 of the mop handle 20 to the tubular headband wet mop 12. Jaw teeth 19*a* penetrate the tubular designed headband 12 at its side. A rotor 21 is rotatable to adjust jaw gripping. The closed or bound headband is described as having an outer diameter, however it should be understood that the material within the head band can be collected, rolled, folded or otherwise shaped to form a diameter, as shown in FIG. 3, or can be used in a more elongated configuration.

Figure 4:
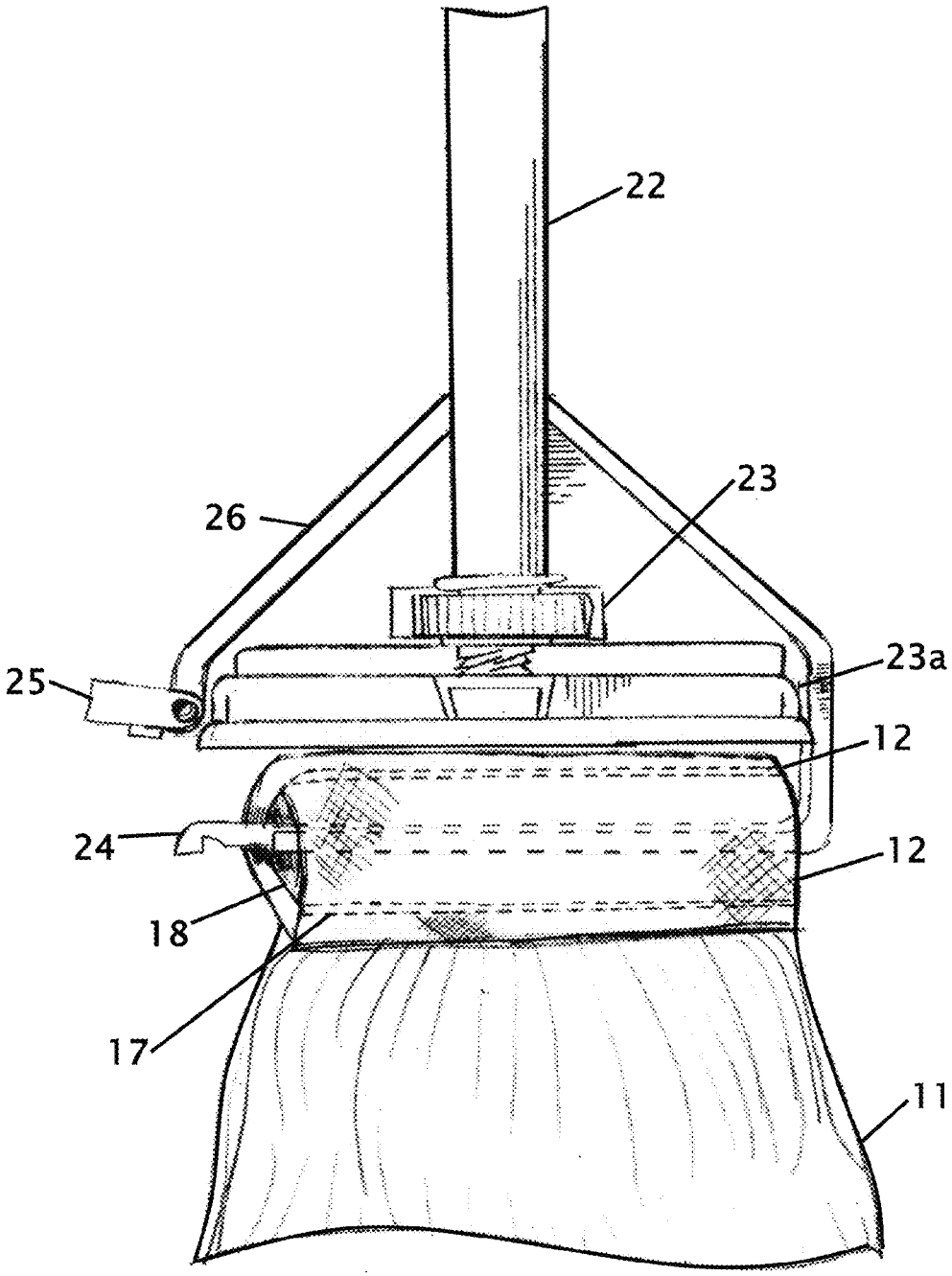
FIG. 4 shows the elements referenced above, with the tubular designed headband mounted on another type of mop handle

FIG. 4 shows the elements referenced above, with the tubular designed headband mounted on another type of mop handle 22. A rotor 23 is adjustable to tighten the plate 23*a* against the headband 12. The clamping arm 24 is inserted through the closed mop head 32. Item 25 shows the locking device that locks onto the clamping arm 24. The mop handle frame 26 is visible spanning from the sides to the mop handle 22.

Figure 5:
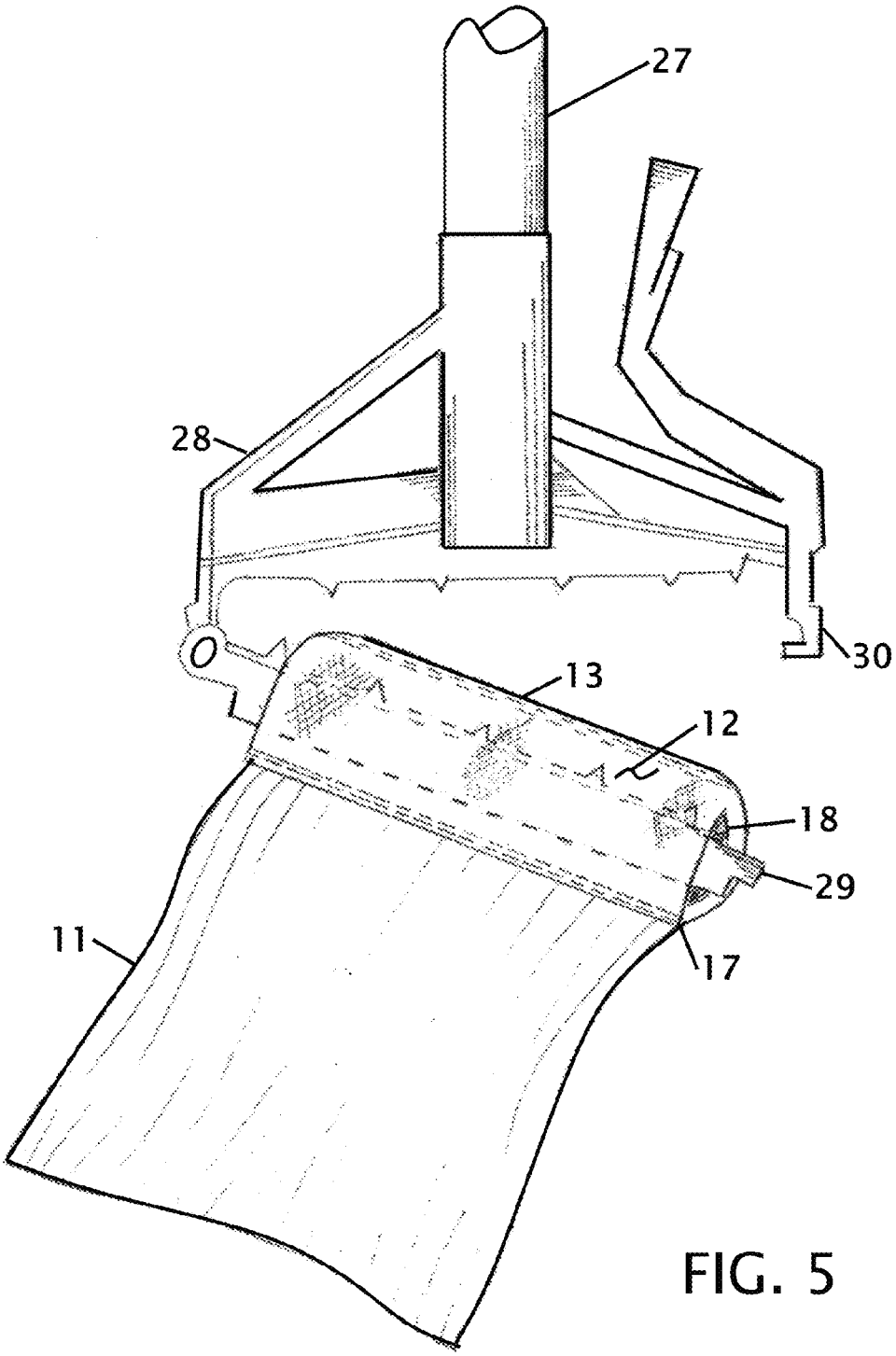
FIG. 5 shows the elements referenced in FIGS. 1, 2 and 3 with the tubular designed headband mounted on another type of mop handle.

FIG. 5 shows the elements referenced in FIGS. 1, 2 and 3, with the tubular designed headband mounted on another type of mop handle 27. Item 29 is the hinged clamping arm that is inserted through the tubular cavity 18. Item 30 shows the locking device that locks onto the hinged clamping arm 29. The mop handle frame 28 extends from the mop gripping area to the mop handle 27.

Figure 6:
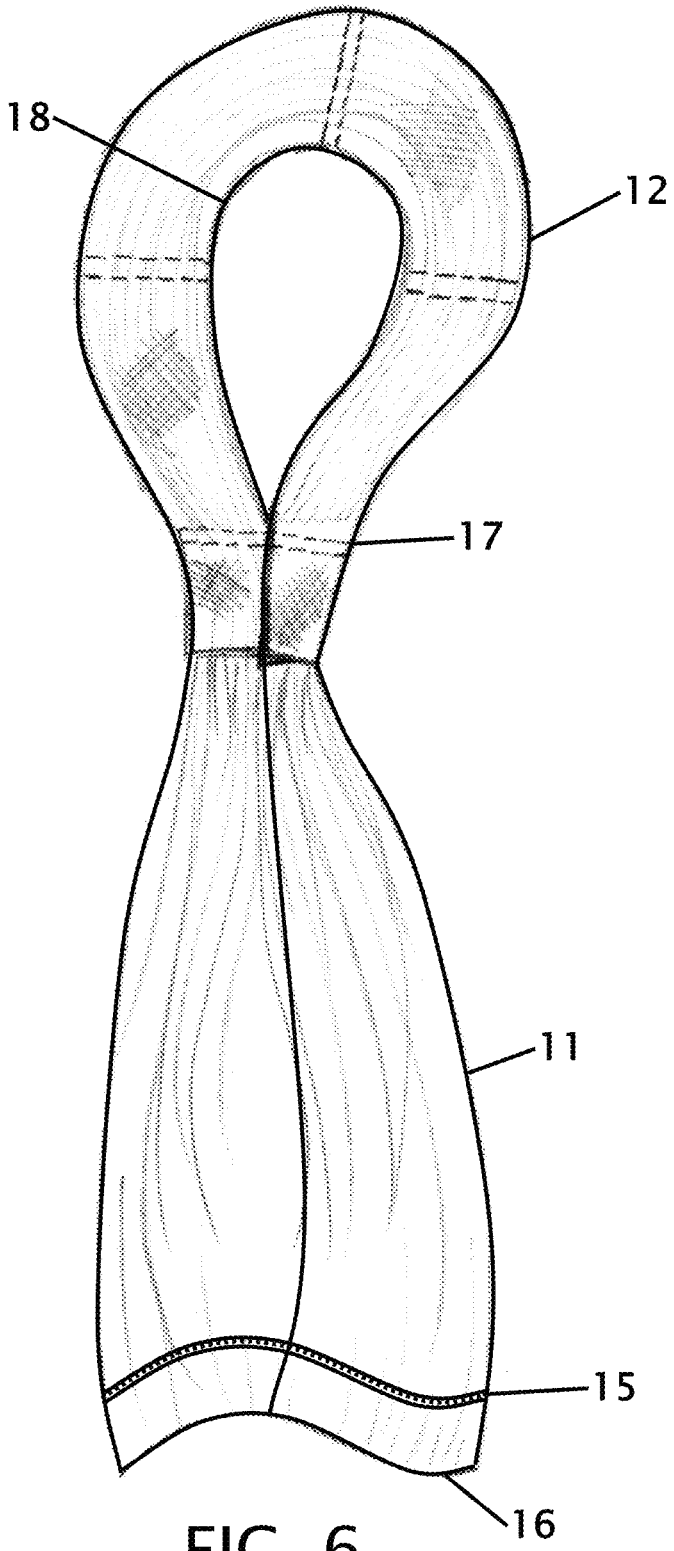
FIG. 6 shows an alternative method for creating the tubular cavity of the tubular headband wet mop wherein the yarns do not end inside the tubular headband.
Figure 7:
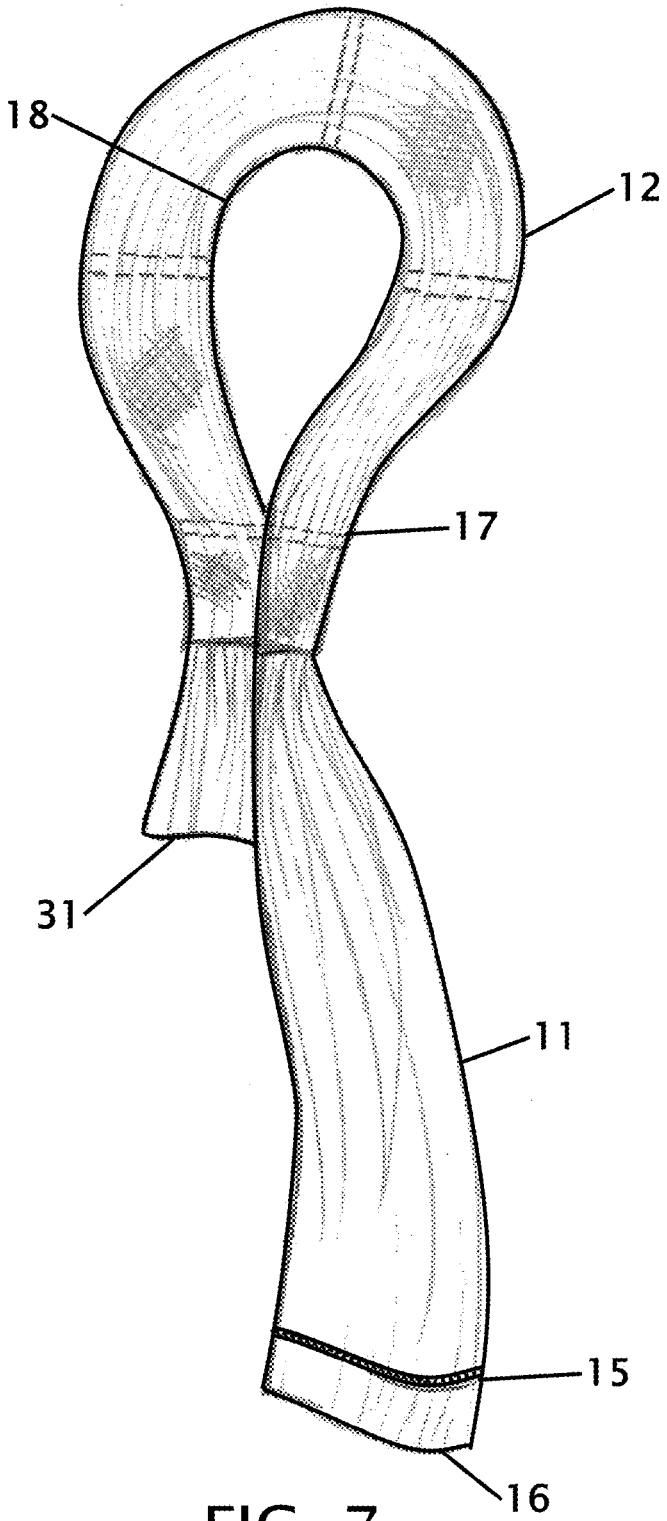
FIG. 7 shows an alternative method for creating the tubular cavity of the tubular headband wet mop wherein the yarns end just outside of the tubular headband.

FIG. 6 shows an alternative method for creating the tubular cavity of the tubular headband wet mop and FIG. 7 shows another alternative method for creating the tubular cavity of the tubular headband wet mop wherein the yarns end just outside 31 of the tubular headband. Item 11 shows the mop strands that pass through both ends of the headband as in a standard wet mop. The enclosing seam 17 shows where the headband overlaps itself and is attached with methods such as, but not limited to seams, tape, or staples in order to create the tubular cavity 18. FIG. 7 shows the yarn strands protruding unequally from the ends of the headband and terminate near the proximal end of the headband.

FIG. 8 shows the wet mop with the headband prior to the headband being sewn over in a closed or looped configuration. The mop strands 11 are shown passing into the headband 12. This figure shows that the ends 14 of the mop strands 11 terminate a limited distance within the headband 12 and do not pass completely through the headband. A filler material 43 extends from the ends 14 to the opposing end of the headband 12. The filler material 43 provides structural strength to the headband 12 and can be made from a variety of materials. In the preferred embodiment, the filler material is a yarn, but other materials are contemplated that would provide equivalent function. In fabricating the tubular headband, the free end 40 is folded over 42 to join the secured end 41 to make the headband as shown in FIGS. 2-6. The filler material 43 and the mop strands 11 are sewn to the headband 12 at various locations 13. The location and form of the seam patterns 13 are shown for reference, but can be located at any location. This figure shows contemplated locations 13 where possible seam patterns which are designed to retain the yarn strands and any filler and provide shaping and support to the headband. These seam patterns may be changed due to manufacturing or other techniques or reasons. The mop shown has one tail band 15, but could have 0 to 5 tail bands. Item 16 is the end of the mop which may be cut end, or looped end.

The element of the enclosed tubular cavity is necessary to create the ease of mounting, to protect floors from contact with the mop handle clamping device and to enable the reduction of yarn by eliminating two sides of the mop. The ideal use of the tubular headband wet mop would be with the yarns ending inside the headband, creating a two-sided wet mop and reducing the weight of the wet mop.

The tubular headband wet mop is installed by sliding the clamping arm through the tubular cavity and locking the clamping arm or by inserting the tubular headband into the jaw teeth of a jaw style mop handle and clamping closed.

A standard wet mop has yarn protruding from both sides of a flat headband of fabric or mesh, with typically equal amounts of yarn on each side of the headband. This flat headband is then centered and draped over a clamping device essentially folding the mop in half. No other wet mop with a headband uses an enclosed design like the enclosed tubular design with the yarns ending inside of the headband. The tubular design is self-balancing and self-centering, and has the flexibility of eliminating one side of yarn strands.

The process of mounting the standard wet mop can be cumbersome because it requires that the mop be centered and balanced over a clamping arm, while ensuring that no yarn strands get hung up on the handle, and securing the wet mop, while at the same time holding the mop handle upright. The tubular design creates a very simplistic mounting process by simply sliding the tubular mounting cavity over a clamping device, eliminating the need to balance and eliminating or reducing yarn hang-up during mounting.

The tubular design can also eliminate the need for the second side of a wet mop, while maintaining or increasing the floor surface coverage area. Because the headband is a tubular design, there is no second side needed, the band is circular, and is designed to allow for only one section of protruding yarn fabrics from the headband. By incorporating the tubular headband, one of those sides can be eliminated with the yarn ending inside of the headband, reducing the amount of yarn incorporated into the wet mop.

Standard wet mops can open during use and expose the floor surfaces and finishes to damage from the mop handle. The tubular design completely encloses the clamping device eliminating damages caused by contact of the mop handle with the flooring surfaces, coatings and finishes.

The tubular headband wet mop may have its enclosed tubular cavity created as one of the following:

A headband covered filler material and a series of yarn strands ending or looping inside the headband, with the headband area sealed with seams or other enclosing methods, creating a tubular cavity;

A headband covered filler material and a series of yarn strands protruding from both sides of the headband, either equally or not, with the headband area sealed with seams or other enclosing methods, creating a tubular cavity;

A series of yarn strands with or without filler material that are formed into a tubular cavity with seams, tape or other methods with the cavity located in the center or other location on the yarn strands.

The tubular headband wet mop would be installed by sliding the clamping arm through the tubular cavity and locking the clamping arm or by inserting the tubular headband into the jaw teeth of a jaw style mop handle and clamping closed.

Thus, one preferred specific embodiment of a tubular headband mounted wet mop have been disclosed that illustrates a best mode now contemplated for putting the tubular headband mounted wet mop into practice. The tubular headband mounted wet mop is described in detail without attempting to show all of the various forms and modifications in which the tubular headband mounted wet mop might be embodied. It should be apparent to those skilled in the art that many more modifications besides those described are possible without departing from the inventive concepts herein. The inventive subject matter, therefore, is not to be restricted except in the spirit of the appended claims.

The invention claimed is:

1. A wet mop with a tubular cavity comprising:

a plurality of collected elongated yarn strands at a first end at a location within a headband that protrude from only a first end of said headband to an unsecured end;

said plurality of elongated yarn strands being sewn or otherwise bound within said headband;

a filler material that approximates a thickness of said elongated yarn strands is secured within said headband in an area that is not occupied by said plurality of elongated yarn strands;

said headband and said filler material are folded or looped between said first end of said headband to a location at a second end of said headband, thereby said wet mop has a headband in a looped configuration.

2. The wet mop with a tubular cavity according to claim 1 wherein the filler material is secured within the headband by at least one of tape, sewn seams, adhesives, fabric, staples and mesh.

3. The wet mop with a tubular cavity according to claim 2 wherein said filler material and said headband is a yarn fabric or mesh having a width of between 2.5 inches and 12 inches.

4. The wet mop with a tubular cavity according to claim 1 wherein the filler material is secured within the headband by a clamping or binding device that creates a closed tubular cavity.

5. The wet mop with a tubular cavity according to claim 1 wherein said headband allows for securing said mop by gripping on an outside of said mop headband or insertion of a clamping arm through said mop headband.

6. The wet mop with a tubular cavity according to claim 1 wherein said tubular cavity has an interior diameter of between 0.5 inches and 3 inches.

7. The wet mop with a tubular cavity according to claim 1 wherein said headband has a length of between 1 inch and 15 inches.

8. The wet mop with a tubular cavity according to claim 7 wherein said headband has a length of between 5 inches and 8 inches.

9. A wet mop with a bound headband comprising:

a plurality of collected elongated yarn strands at a first end at a location within a head that protrude from only a first end ene-side of said head to an unsecured end;

said plurality of elongated yarn strands being sewn or otherwise bound within said head;

a filler material that thickens said head beyond a thickness of said elongated yarn strands is secured within said head in an area that is not occupied by said plurality of elongated yarn strands;

said head and said filler material are folded, rolled or looped adjacent said first end in said head to form a loop, thereby said wet mop has a head in a looped configuration thereby forming a bound headband.

10. The wet mop with a bound headband according to claim 9 wherein the filler material is secured by at least one of tape, sewn seams, adhesives, fabric, staples and mesh.

11. The wet mop with a bound headband according to claim 9 wherein the filler material is secured by a clamping or binding device on said bound headband.

12. The wet mop with a bound headband according to claim 9 wherein said bound headband allows for securing said mop by gripping on an outside of said bound headband.

13. The wet mop with a bound headband according to claim 9 wherein said filler material is a yarn fabric or mesh that fits completely within said bound headband.

14. The wet mop with a bound headband according to claim 9 wherein said filler material is yarn strands.

15. The wet mop with a bound headband tubular cavity according to claim 9 wherein said filler material and said headband is a yarn fabric or mesh that extends outside of said head.

16. The wet mop with a bound headband according to claim 9 wherein said headband has a length of between 1 inch and 15 inches.

17. The wet mop with a bound headband according to claim 16 wherein said headband has a length of between 5 inches and 8 inches.

18. The wet mop with a bound headband according to claim 9 that further includes at least one tailband.

* * * * *